United States Patent [19]

Kondo et al.

[11] Patent Number: 4,796,519

[45] Date of Patent: Jan. 10, 1989

[54] PREFABRICATED WINDOW UNIT WITH AIR CONDITIONING SYSTEM

[75] Inventors: Hiroshi Kondo; Toshimasa Kusunoki, both of Funabashi; Ryo Kameda, Chiba, all of Japan

[73] Assignee: Yoshida Kogyo K. K., Tokyo, Japan

[21] Appl. No.: 93,043

[22] Filed: Sep. 4, 1987

[30] Foreign Application Priority Data

Sep. 8, 1986 [JP] Japan ..... 61-136689[U]

[51] Int. Cl.[4] ..... E06B 7/02

[52] U.S. Cl. ..... 98/97; 52/171; 52/209; 52/304; 98/88.1; 426/429; 426/431

[58] Field of Search ..... 52/171, 209, 302–305; 98/88.1, 97; 126/419, 428, 429, 431

[56] References Cited

U.S. PATENT DOCUMENTS

| | | | |
|---|---|---|---|
| Re. 31,955 | 7/1985 | Shiga et al. | 52/209 |
| 4,224,771 | 9/1980 | Dunsmore | 52/171 |
| 4,296,734 | 10/1981 | Nevins | 126/431 |
| 4,370,837 | 2/1983 | Larguia | 52/1 |
| 4,577,619 | 3/1986 | Howe, Jr. | 126/431 |
| 4,641,466 | 2/1987 | Raninen et al. | 52/171 |
| 4,679,406 | 7/1987 | Weiblen | 62/262 |

FOREIGN PATENT DOCUMENTS

| | | | |
|---|---|---|---|
| 2452069 | 11/1980 | France | 126/429 |
| 59-29930 | 2/1984 | Japan . | |

*Primary Examiner*—John E. Murtagh
*Assistant Examiner*—Andrew Joseph Rudy
*Attorney, Agent, or Firm*—Hill, Van Santen, Steadman & Simpson

[57] ABSTRACT

A prefabricated window unit with an air conditioning system in which cold or hot air is passed through hollow vertical and horizontal members forming a framework of the window unit, and the air is blown out through a blow part formed in the framework toward a room, whereby the room air is conditioned by thermal radiation to or from the framework and by the air blown from the framework. Hollow spaces formed in an upper horizontal member and a waist transom are partitioned into indoor side and outdoor side hollow space portions. In a windowpane frame section consisting of left and right vertical members, the upper horizontal member and the waist transom connected horizontally between the vertical members, are delimited a sealingly enclosed space including a blind by indoor side and outdoor side transparent plates mounted to the outdoor side portion of the windowpane frame section. The air is circulated from an air feed duct through the indoor side hollow space portions, the blow part, the room, a suction part on the framework, the sealingly enclosed space, and the outdoor side hollow space portion to an air recovery duct. Thus, upon air-conditioning, heat accumulated on the blind as irradiated by sunshine can be removed or absorbed by the conditioned air.

2 Claims, 4 Drawing Sheets

PREFABRICATED WINDOW UNIT WITH AIR CONDITIONING SYSTEM

BACKGROUND OF THE INVENTION

1. Field of the Invention

The present invention relates to a prefabricated window unit in which conditioned air such as cold air or hot air is passed through hollow vertical members and hollow horizontal members constituted of extruded section members of aluminium or any of aluminium alloys and forming a framework of the window unit, and the conditioned air is blown out from the window framework into a room, whereby the room is cooled or heated by thermal radiation to or from the framework and the conditioned air blown from the framework.

2. Description of the Prior Art

Heretofore, a prefabricated curtain wall unit with an air conditioning system, in which thermal medium such as cold water or hot water is passed through vertical members and horizontal members constituted of extruded section members of aluminium or any of aluminium alloys and forming the curtain wall unit, thermal energy possessed by the thermal medium is dissipated into a room as thermal radiation or thermal energy is absorbed from the room by the thermal medium as thermal radiation, and conditioned air such as cold air or hot air is blown out from the horizontal members, has been known as disclosed, for example, in Japanese Patent Application Laid-open Specification No. 59-29930 (1984).

Such type of curtain wall units can provide a comfortable air-conditioned space, in which in distinction from the conventional package type cooling and heating apparatus in the prior art, an air flow is not felt by a human body, and even in the proximity of a window one feels comfortable.

In the case of the above-mentioned curtain wall unit in the prior art, however, when sunshine irradiates a room directly through a window in the curtain wall, sometimes air-conditioning in the room would be disturbed by the direct irradiation of sunshine.

SUMMARY OF THE INVENTION

It is therefore one aim of the present invention to provide a prefabricated window unit with an air conditioning system in which a cooling and heating efficiency is improved.

A more specific aim of the present invention is to provide a prefabricated window unit with an air conditioning system in which air-conditioning in a room would not be disturbed, even when sunshine irradiates the room directly through the window.

According to one feature of the present invention, there is provided a prefabricated window unit with an air conditioning system, in which a blind (Venetian blind or a louvre) is disposed within a sealingly enclosed space delimited between outdoor side and indoor side transparent plates mounted to a window frame to shield sunshine, and heat applied to the blind from the sunshine is removed or absorbed by passing conditioned air that is blown out of the window frame into a room and then recovered to the window frame, through the sealingly enclosed space containing the blind.

According to a more specific feature of the present invention, there is provided a prefabricated window unit with an air conditioning system comprising a rectangular framework consisting of left and right vertical members, an upper horizontal member and a lower horizontal member, a waist transom disposed between and connected to the left and right vertical members, a sealingly enclosed space delimited by indoor side and outdoor side transparent plates mounted to the outdoor side portion of a windowpane frame section consisting of the left and right vertical members, the upper horizontal member and the waist transom, a blind or louvre disposed within the sealingly enclosed space, indoor side hollow space portions formed in the upper horizontal member and the waist transom, respectively, so as to open at and communicate with hollow space portions in the vertical members, outdoor side hollow space portions formed in the upper horizontal member and the waist transom, respectively, so as to open at and communicate with the sealingly enclosed space, an air feed duct connected to the indoor side hollow space portion in the upper horizontal member, an air recovery duct connected to the outdoor side hollow space portion in the upper horizontal member a blow port for opening one of the indoor side hollow space portions formed in the waist transom toward a room, and a suction port for opening one of the outdoor side hollow space portions formed in the waist transom toward the room.

Owing to the above-described construction of the window unit, according to the present invention, a room can be cooled or heated by thermal radiation to or from the upper horizontal member, the vertical members and the waist transom, and by conditioned air fed through the air feed duct and blown through the blow port, sunshine is prevented from directly irradiating the room by means of the blind, furthermore heat applied to the blind from sunshine can be removed or absorbed by the conditioned air being recovered, and thereby cooling and heating of the room can be achieved efficiently.

The above-mentioned and other objects, features and advantage of the present invention will become more apparent by reference to the following description of one preferred embodiment of the invention taken in conjunction with the accompanying drawings.

DESCRIPTION OF THE PREFERRED EMBODIMENTS

Figure 1:
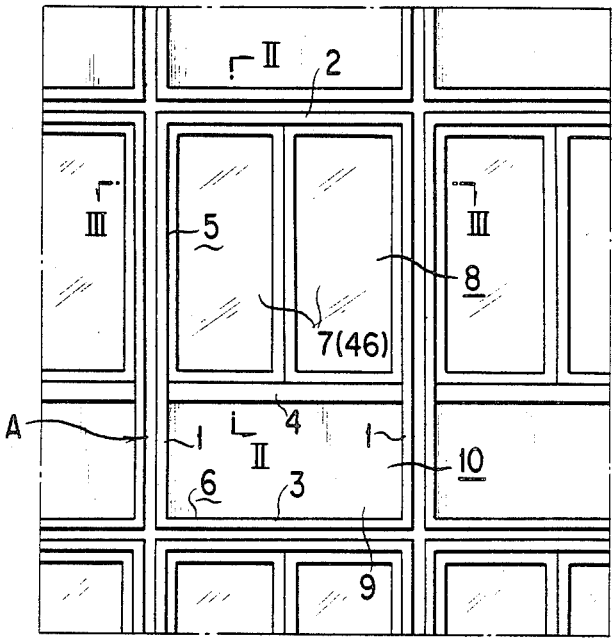
FIG. 1 is a schematic indoor-side front view of a prefabricated curtain wall unit such as a prefabricated window unit with an air conditioning system of a unit type curtain wall according to one preferred embodiment of the present invention.

Referring now to FIG. 1, in a prefabricated unit type curtain wall, a curtain wall unit A taking a form of a window unit with an air conditioning system is constructed by the elements of a pair of left and right vertical members 1, 1, an upper horizontal member 2, a lower horizontal member 3 and a waist transom 4 which are constituted of extruded hollow section members of aluminium or any of aluminium alloys and assembled into a rectangular framework. A windowpane frame section 5 and a panel frame section 6 are respectively formed above and below the waist transom 4, openable window elements 7 are mounted to the windowpane frame section 5 to form a windowpane section 8, and a heat-insulating panel 9 is mounted to the panel frame section 6 to form a panel section 10.

Figure 2:
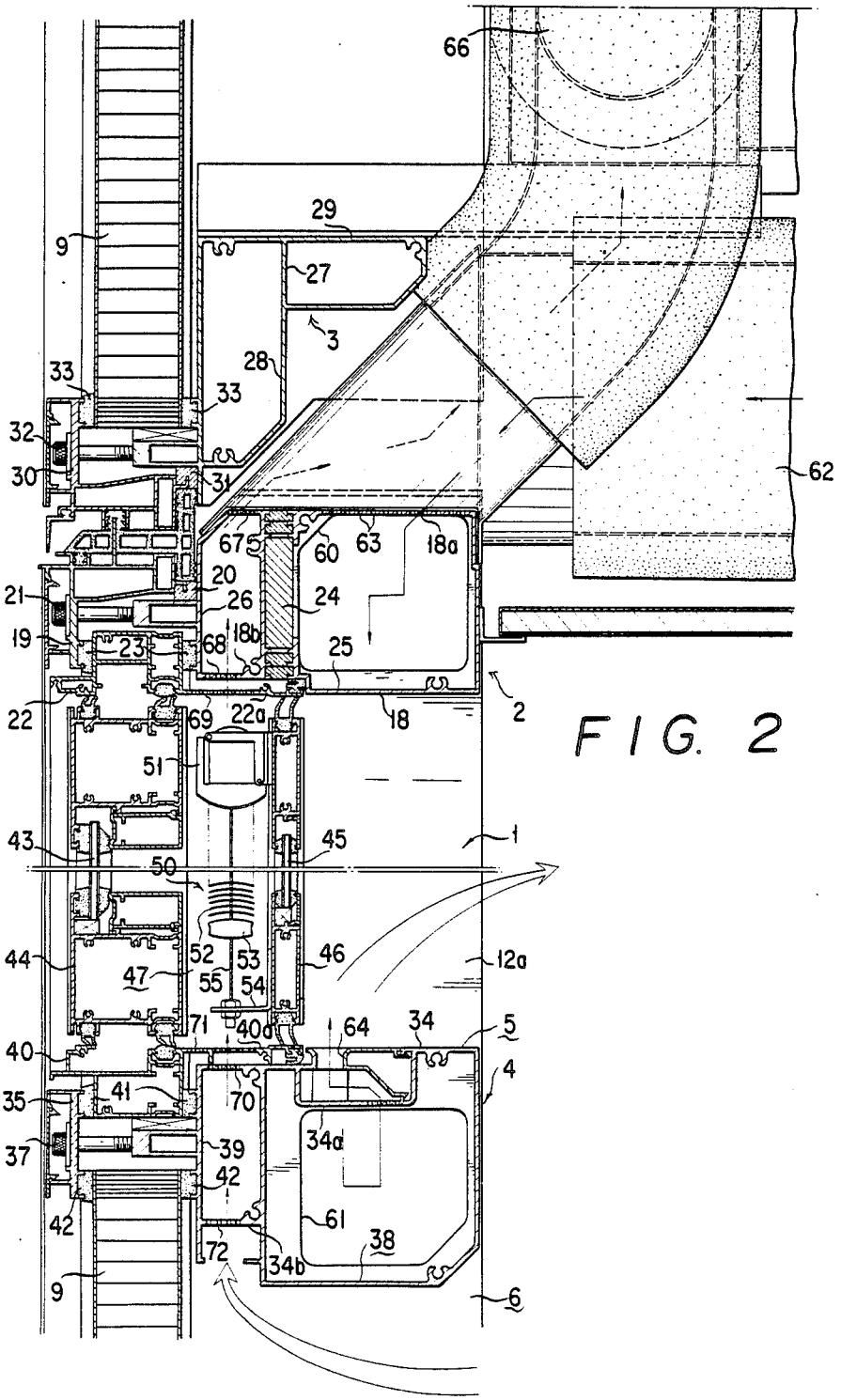
FIG. 2 is a detailed vertical cross-section view taken along line II—II in FIG. 1 as viewed in the direction of arrows.
Figure 3:
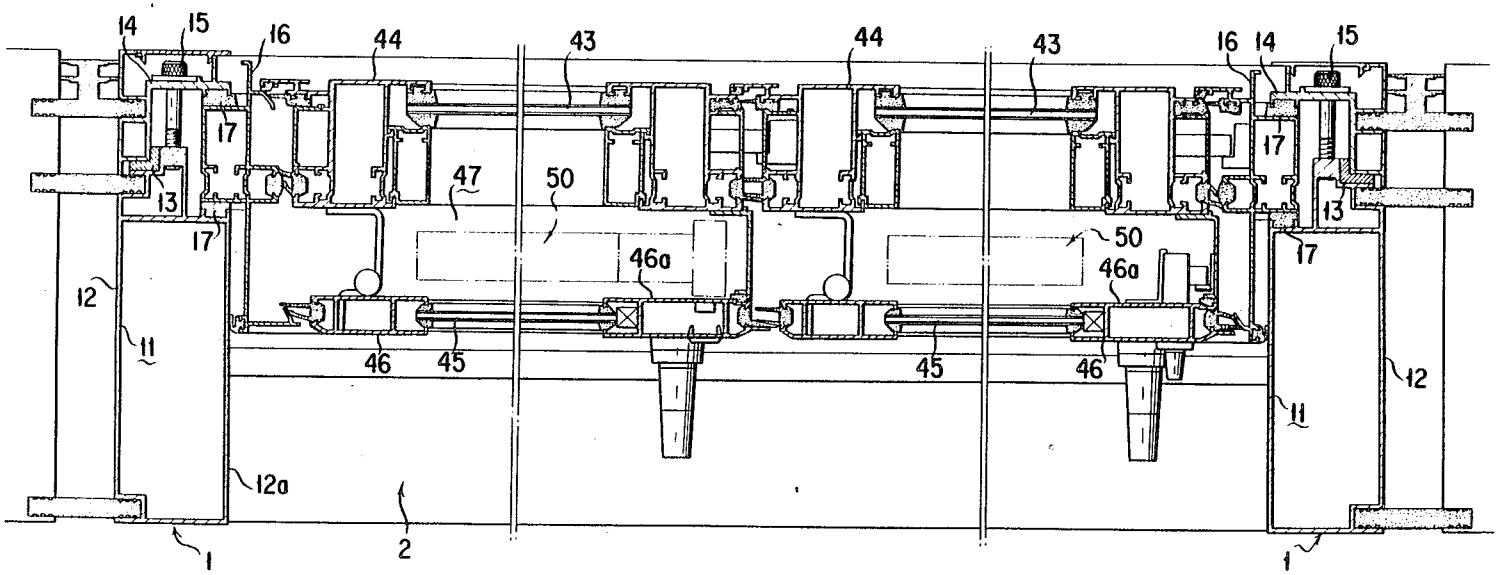
FIG. 3 is a detailed horizontal cross-section view taken along line III—III in FIG. 1 as viewed in the direction of arrows.

As shown in FIG. 3, in the above-mentioned vertical member 1, on the outdoor side of an indoor side member 12 having a hollow space 11 is connected an outdoor side member 14 via a heat-insulating member 13 by means of bolts 15, and a vertical attachment 16 is mounted between the indoor side member 12 and the outdoor side member 14 via heat-insulating members 17. As shown in FIG. 2, in the upper horizontal member 2, on the outdoor side of an indoor side member 18 is connected an outdoor side member 19 via a heat-insulating member 20 by means of bolts 21, and an upper horizontal attachment 22 is mounted between the indoor side member 18 and the outdoor side member 19 via heat-insulating members 23. The indoor side member 18 includes an indoor side hollow space portion 25 and an outdoor side hollow space portion 26 partitioned by a heat insulating member 24, and an indoor side horizontal projection **22*a* of the upper horizontal attachment 22 protrudes beyond the heat-insulating member 24 up to the indoor side hollow space portion 25**.

As shown in FIG. 2, the above-referred lower horizontal member 3 is formed by connecting an indoor side member 29 including an indoor side hollow space portion 27 and an outdoor side hollow space portion 28 to an outdoor side member 30 via a heat-insulating member 31 by means of bolts 32, and a lower edge portion of the heat-insulating panel 9 is mounted via heat-insulating members 33 between the indoor side member 29 and the outdoor side member 30.

In the waist transom 4, as shown in FIG. 2, an indoor side member 34 and an outdoor side member 35 are connected by means of bolts 37. The indoor side member 34 includes an indoor side hollow space portion 38 and an outdoor side hollow space portion 39 bounded by a partition wall **34*a*. A lower horizontal attachment 40 is mounted via heat-insulating members 41 above a gap space between the indoor side member 34 and the outdoor side member 35. Also below the gap space is mounted an upper edge portion of the panel 9 via heat-insulating members 42. An indoor side horizontal projection 40*a* of the lower horizontal attachment 40 protrudes beyond the partition wall 34*a* up to the indoor side hollow space portion 38 so as to be equal in depth to the indoor side horizontal projection 22*a* of the above-described upper horizontal attachment 22**.

More particularly, the vertical attachments 16 and the upper and lower horizontal attachments 22 and 40 have the same depth in the direction perpendicular to the plane of the window and are assembled into a rectangular frame, and within this frame are mounted a pair of rotary window elements 44 each provided with an outdoor side transparent plate 43 and a pair of inwardly opening casement window elements 46 each provided with an indoor side transparent plate 45. Between the outdoor side transparent plate 43 and the indoor side transparent plate 45 is formed an airtightly sealed space 47, and a blind 50 such as, for example, a Venetian blind or a louvre is mounted within this space 47.

The blind 50 comprises a blind case 51 mounted on an outdoor side surface of an upper portion of a vertical rail **46*a* of the inwardly opening casement window element 46, a large number of slats 52 and a bottom rail 53. The slats 52 and the bottom rail 53 are freely movable in the vertical direction along guide wires 55 stretched between a bracket 54 mounted on an outdoor side surface of a lower portion of the vertical rail 46*a* and the blind case 51, and so when the inwardly opening casement window element 46 is opened to the indoor side, the blind 50** is exposed to the indoor side so as to facilitate inspection and cleaning of the blind.

The depths in the direction perpendicular to the plane of the window of the above-described respective indoor side members 12, 18, 29 and 34 are substantially the same. Accordingly the end surfaces of the indoor side members 18, 29 and 34 of the upper and lower horizontal members 2 and 3 and the waist transom 4 are butt-connected to an inner wall **12*a* of the indoor side member 12 of the vertical member 1, and the indoor side hollow space portion 25 of the upper horizontal member 2 and the indoor side hollow space portion 38 of the waist transom 4 open at and communicate with the hollow space 11 of the vertical member 1 through upper and lower openings 60 and 61 formed in the inner wall 12*a* of the indoor side member 12. In addition, an air feed duct 62 is connected to a central portion in the lengthwise direction of a top wall 18*a* of the indoor side member 18 of the upper horizontal member 2 and also opens at and communicates with the indoor side hollow space portion 25 via through-holes 63. A blow port 64 is formed in an inner wall 34*a* of the indoor side hollow space portion of the waist transom 4, and an air recovery duct 66 is connected via a pair of chambers 65 on both sides in the lengthwise direction of the top wall 18*a* of the indoor side member 18 of the above-described upper horizontal member 2. This air recovery duct 66 opens at and communicates with the outdoor side hollow space portion 26 via through-holes 67 formed in the chamber 65 and the top wall 18*a*, this outdoor side hollow space portion 26 opens at and communicates with the above-described sealed space 47 via through-holes 68 formed in an inner wall 18*b* and through-holes 69 formed in the indoor side horizontal projection 22*a*. The outdoor side hollow space portion 39 of the above-described waist transom 4 opens at the sealingly enclosed space 47 via through-holes 70 formed in the inner wall 34*a* and through-holes 71 formed in the indoor side horizontal projection 40*a*, and also opens at and communicates with a space on the indoor side of the panel 9, that is, the room space via through-holes 72 formed in a bottom wall 34*b***.

The above-described air feed duct 62 and air recovery duct 66 are connected to an air conditioning equipment not shown so that conditioned air such as cold air or hot air may be fed through the air feed duct 62 and the air blown out within a room may be recovered through the air recovery duct 66.

Figure 4:
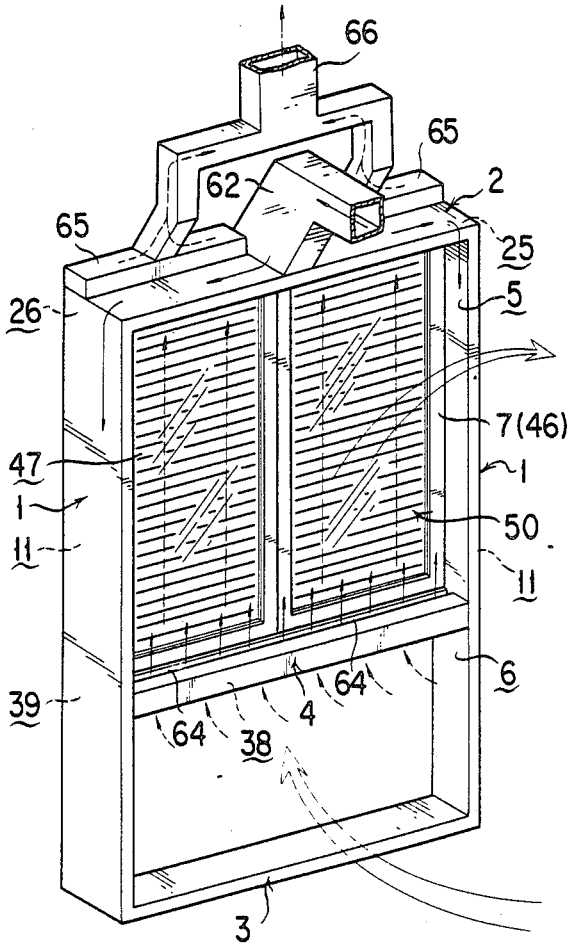
FIG. 4 is a general perspective view of the window unit with an air conditioning system according to the present invention shown in FIGS. 1 to 3.

Owing to the above-mentioned construction, as shown by solid line arrows in FIG. 4, the conditioned air fed through the air feed duct 62 is passed through the indoor side hollow space portion 25 in the upper horizontal member 2, this conditioned air then flows through the hollow space portions 11 in the left and right vertical members 1 and enters the indoor side hollow space portion 38 in the waist transom 4, and the conditioned air is blown out of the blow port 64 into the room.

Consequently, the room space is cooled or heated by thermal radiation to or from the upper horizontal member 2, left and right vertical members 1 and waist transom 4, and by the conditioned air blown out of the blow port 64.

The above-described conditioned air blown out into the room is sucked jointly with the air in the room into the outdoor side hollow space portion 26 in the upper horizontal member 2 through the outdoor side hollow space portion 39 in the waist transom 4 and the sealingly enclosed space 47 as shown by dotted line arrows in FIG. 4, and then recovered into the air recovery duct 66 through the chambers 65.

On the other hand, in the sealingly enclosed space 47 is disposed a blind 50 so that sunshine may not directly irradiate a room, and thereby air-conditioning in the room can be prevented from being disturbed by direct irradiation of sunshine. While the temperature in the enclosed space 47 would be raised by the heat applied to the blind 50 from the sunshine, when the air recovered through the above-mentioned air recovery duct 66 flows through that space 47, the air would remove or absorb the heat applied to the blind 50, and thereby a cooling or heating efficiency can be remarkably improved.

For instance, in the summer season when the atmospheric temperature is high, the blind 50 is cooled by conditioned air consisting of cold air to reduce thermal radiation from the blind 50, and thereby a cooling efficiency can be improved, while in the winter season when the atmospheric temperature is low, heat accumulated in the blind is absorbed by the recovered conditioned air consisting of hot air and sent to the air conditioning equipment, so that fresh air to be conditioned can be previously heated by making heat-exchange in the air conditioning equipment so as to raise the heating air temperature, and thereby a heating efficiency can be remarkably improved.

As described in detail above, according to the present invention, the conditioned air fed through the air feed duct 62 can flow through the indoor side hollow space portion 25 in the upper horizontal member 2, the hollow space portions 11 in the vertical members 1 and the indoor side hollow space portion 38 in the waist transom 4 and can be blown out from the blow port 64 into the room, and so, the room space can be cooled or heated by thermal radiation to or from the upper horizontal member 2, vertical members 1 and waist transom 4 and by the conditioned air blown out of the blow port 64.

Furthermore, the sunshine is prevented from directly irradiating a room by the blind 50, hence the air conditioning in the room would not be disturbed by direct irradiation of the sunshine, and moreover, since the blown conditioned air flows jointly with the air in the room through the space 47 in which the blind 50 is disposed, and is recovered through the air recovery duct 66, heat applied from the sunshine to the blind 50 is removed or absorbed by the air flowing through the space 47, and thereby a cooling or heating efficiency can be remarkably improved.

Since many changes and modifications can be made to the above-described construction without departing from the spirit of the present invention, it is intended that all matter contained in the above description and illustrated in the accompanying drawings shall be interpreted to be illustrated and not in a limiting sense.

What is claimed is:

1. A prefabricated window unit comprising a rectangular framework consisting of left and right vertical members, an upper horizontal member and a lower horizontal member, a waist transom disposed between and connected to said left and right vertical members, a sealingly enclosed space delimited by indoor side and outdoor side transparent plates mounted in a window-pane frame section consisting of said left and right vertical members, said upper horizontal member and said waist transom, a blind disposed within said sealingly enclosed space indoor side hollow space portions formed in said upper horizontal member and said waist transom, respectively, so as to open at and communicate with hollow space portions in said vertical members, outdoor side hollow space portions formed in said upper horizontal member and said waist transom, respectively, so as to open at and communicate with said sealingly enclosed space, an air feed duct connected to said indoor side hollow space portion in said upper horizontal member, an air recovery duct connected to said outdoor side hollow space portion in said upper horizontal member, a blow port for opening said indoor side hollow space portion in said waist transom to a room, and a suction port for opening said outdoor side hollow space portion in said waist transom to said room.

2. A prefabricated window unit with an air conditioning system as claimed in claim 1, wherein said indoor side hollow space portion and said outdoor side hollow space portion in said upper horizontal member are partitioned via a heat-insulating member.

* * * * *